US010674843B2

(12) United States Patent
Kaffee

(10) Patent No.: US 10,674,843 B2
(45) Date of Patent: Jun. 9, 2020

(54) APPARATUS FOR HANGING PICTURES ON A WALL

(71) Applicant: Brian Kaffee, Montvale, NJ (US)

(72) Inventor: Brian Kaffee, Montvale, NJ (US)

( * ) Notice: Subject to any disclaimer, the term of this patent is extended or adjusted under 35 U.S.C. 154(b) by 0 days.

(21) Appl. No.: 16/280,385

(22) Filed: Feb. 20, 2019

(65) Prior Publication Data

US 2020/0015608 A1 Jan. 16, 2020

Related U.S. Application Data

(60) Provisional application No. 62/747,238, filed on Oct. 18, 2018, provisional application No. 62/697,103, filed on Jul. 12, 2018.

(51) Int. Cl.

| | |
|---|---|
| ***A47F 7/14*** | (2006.01) |
| ***A47G 1/16*** | (2006.01) |
| ***A47G 1/24*** | (2006.01) |
| *A47G 1/06* | (2006.01) |

(52) U.S. Cl.

CPC ..... *A47G 1/1666* (2013.01); *A47G 1/1613* (2013.01); *A47G 1/24* (2013.01); *A47G 1/06* (2013.01)

(58) Field of Classification Search

CPC ..... A47G 1/16; A47G 1/1606; A47G 1/1613; A47G 1/20

See application file for complete search history.

(56) References Cited

U.S. PATENT DOCUMENTS

| | | | | |
|---|---|---|---|---|
| 2,180,211 | A * | 11/1939 | Kellogg | A47G 1/168 248/493 |
| 4,775,129 | A * | 10/1988 | Gleisten | A47G 1/162 248/493 |
| 5,482,244 | A * | 1/1996 | Hickey | A47G 1/20 248/489 |
| 9,279,538 | B1 * | 3/2016 | Wening | F16M 13/022 |
| 2011/0290965 | A1 * | 12/2011 | Virgin | G06F 1/1632 248/205.3 |
| 2012/0112022 | A1 * | 5/2012 | Cheng | A47G 7/044 248/205.3 |
| 2019/0082862 | A1 * | 3/2019 | Franco | F16M 13/02 |

* cited by examiner

*Primary Examiner* — Amy J. Sterling
(74) *Attorney, Agent, or Firm* — Abelman, Frayne & Schwab

(57) ABSTRACT

A wall hanger for hanging an object on a wall via a wire includes a wall mounting member having a planar rear portion for mounting to the wall, a front portion spaced apart from the rear and bottom portions. The rear, bottom and front portions define a horizontal ledge with a first keying arrangement that is accessible from above the wall mounting member. A wire retention member has lower and upper shells connected by a hinge to open and close the lower and upper shells, and receive the wire. The lower and upper shells have peripheral edges with a second keying arrangement corresponding with the first keying arrangement. The first and second keying arrangements are configured to engage with each other when the wire retention member is in its closed position. A plurality of locking members engages and locks the wire retention member in the closed position.

11 Claims, 11 Drawing Sheets

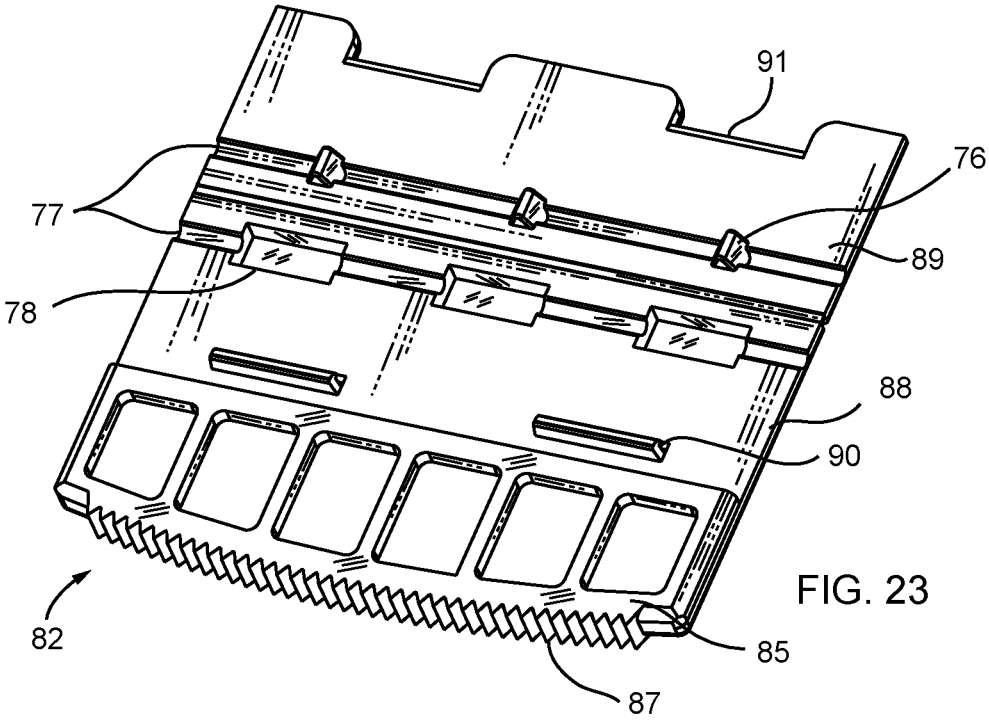
FIG. 23
FIG. 24
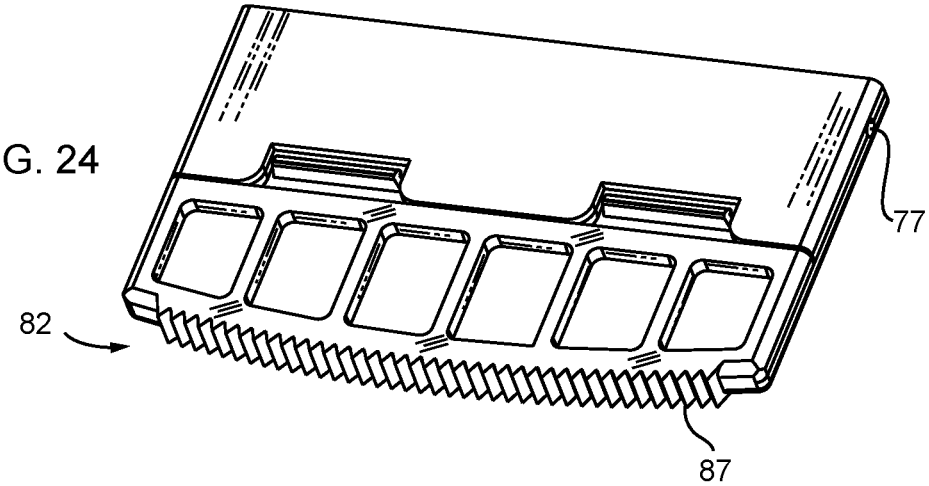
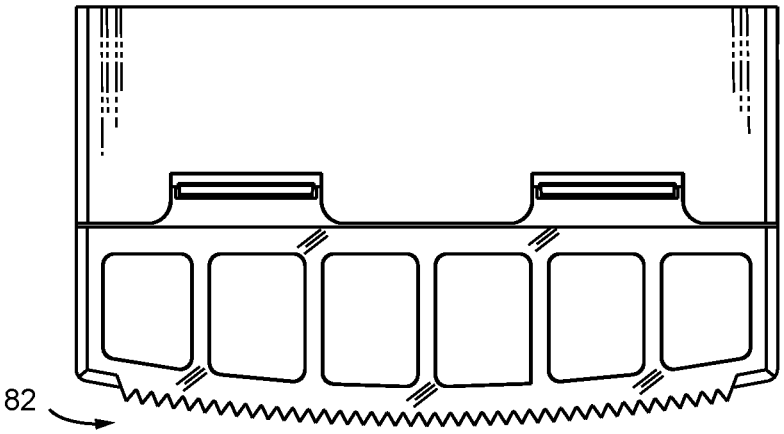
FIG. 25

APPARATUS FOR HANGING PICTURES ON A WALL

CROSS-REFERENCE TO RELATED APPLICATION

This patent application claims the benefit of U.S. Provisional Application No. 62/747,238, filed Oct. 18, 2018 and U.S. Provisional Application No. 62/697,103, filed Jul. 12, 2018, the contents of which are incorporated by reference herein in their entireties.

FIELD OF INVENTION

The invention relates to a picture wall hanger, and more specifically to a wall mount hanger having an anti-slip member for maintaining a picture frame in a vertical orientation when hung on a wall with a picture frame wire.

BACKGROUND OF INVENTION

Pictures and other object are often hung on a wall using a stranded, braided or solid wire extending substantially horizontally across the back of the picture frame, and a wall mount such as, for example, a nail, hook, and the like driven which is into or otherwise fastened to the vertical wall. The wall mount supports the picture frame on the vertical wall at a desired height above the floor thereunder. Although best intentions are often made to maintain the picture at a predetermined orientation, e.g., perpendicular to the surface thereunder, in time, the hanging pictures often rotate with respect to the wall and appear to be tilted, which leads to time spent straightening the pictures. A primary cause of a picture hanging crooked on a wall is generally due to vibrations arising from one or more sources including persons walking/running nearby, closing and opening of doors and windows, loud music playing in a room, dusting the frame, bumping into the frame, among other vibratory sources that result in the tilting of the frame.

Various wall hanging fasteners have been designed to address the undesirable trait of tilting pictures and other objects hung on a wall. U.S. Pat. No. 4,775,129 depicts a picture wall hanger having slots formed therein for capturing portions of the horizontally strung wire on the back of the frame. This type of wall hanger provides additional frictional forces to try to help maintain the center positioning of the wire on the wall hanger. US application publication no. 2012/0112022A1 depicts a two-piece wall hanger, a first member that is attached to the vertical wall, and a second member that attaches to the back of a picture frame. The first and second wall hanger members have complementary serrated teeth which are set along a curved path, which when engaged with each other, help prevent slippage and tilting of the picture with respect to the wall from which the picture is hung.

Although these and other prior art wall hangers may have had some success to help alleviate the problem of tilted pictures, there is still a need for a hanger or fastener which is easy for a homeowner to hang a picture frame or other object so that it will engage a wall hanging wire in such a way that tilting of the picture is prevented.

SUMMARY OF THE INVENTION

In accordance with the embodiments of the invention described herein, the deficiencies of the prior art are overcome by a wall hanger for hanging an object on a vertical wall via a wire, as illustratively shown and described herein. In one embodiment, a wall hanger for hanging an object on a vertical wall via a wire, comprises: a wall mounting receptacle having a planar rear surface for mounting to the vertical wall, a front portion spaced apart from the rear portion and a bottom portion, said rear, front and bottom portions defining a channel accessible from a top portion of the wall mounting receptacle, the channel having a predetermined depth in a vertical direction and a first keying arrangement; and a wire retention member having a lower shell, an upper shell and a hinge rotatably connecting the lower and upper shells between an open and closed position, the lower and upper shells having peripheral edges with a second keying arrangement corresponding with the first keying arrangement, the first and second keying arrangements configured to engage with each other when the wire retention member is in its closed position; and a plurality of locking members configured to engage and lock the wire retention member in the closed position.

In one aspect, the first and second keying arrangement each comprises a row of tooth-like projections. In another aspect, the first and second keying arrangements are arranged along a curvature.

In one aspect, the plurality of locking members extend outwardly from the lower shell and have a length sufficient to wrap a portion of the wire thereabout in a predetermined pattern. In another aspect, the locking members are extend perpendicular from the lower shell in a triangular arrangement. In yet another aspect, each locking member terminates with a bulbous shaped end.

In another aspect, the upper surface includes a plurality of apertures arranged to receive the plurality of locking members. In still another aspect, the hinge between the upper and lower shells is a living hinge. In a further aspect, the peripheral edges of the upper and lower shells form the second keying arrangement. In yet another aspect, the wall hanger further comprises a channel extending laterally across the lower shell and dimensioned to receive the wire therein.

In one aspect, the upper shell includes a wire engagement member extending normally therefrom and the lower shell includes an opening configured to receive the wire engagement member and a portion of the wire. In another aspect, the wire engagement member and opening are elongated and extend perpendicular to the channel. In yet another aspect, the wire engagement member is triangular.

In another aspect, the wire retention member is a tube having at least one bend and a slit extending laterally the length of the tube for receiving the wire therein, the second keying arrangement being formed on a bottom portion of the tube. In a further aspect, the wire retention member is V-shaped.

In another embodiment, a wall hanger for hanging an object on a vertical wall via a wire, comprises: a wall mounting member having a planar rear surface for mounting to the vertical wall, a front portion spaced apart from the rear portion and a bottom portion, said rear, front and bottom portions defining a ledge accessible from a top portion of the wall mounting member, the ledge having a predetermined width in a horizontal direction and a first keying arrangement; and a wire retention member having a lower shell, an upper shell and a hinge rotatably connecting the lower and upper shells between open and closed positions and configured to receive the wire, the lower and upper shells having peripheral edges with a second keying arrangement corresponding with the first keying arrangement, the first and second keying arrangements configured to engage with each other when the wire retention member is in its closed position; and a plurality of locking members configured to engage and lock the wire retention member in the closed position.

In one aspect, the ledge is arcuate in shape. In another aspect, the first and second keying arrangements include a plurality of teeth configured to interface with each other. In yet another aspect, the ledge extends from the rear portion of the wall mounting member.

In another aspect, the first and second keying arrangements are configured to permit rotation of the wire retention member with respect to the wall mounting member. In a further aspect, the lower and upper shells include opposing grooves which, when in a closed state, form a channel that extends laterally across the wire retention member and which is dimensioned to receive the wire therein. In yet another aspect, at least one of the upper and lower shells includes a wire engagement member to prevent slippage of the wire within the channel.

In still another aspect, the opposing grooves comprises a protrusion extending normally therefrom and a correspondingly aligned cutout formed in the opposing groove, the cutout being configured to accommodate the protrusion and a portion of the wire. In another aspect, the protrusion is triangular shaped. In a further aspect, the wire retention member includes at least one locking member to retain the lower and upper shells in a closed position. In another aspect, the ledge extends from and between opposing lateral edges of wall hanger.

BRIEF DESCRIPTION OF THE DRAWINGS

FIG. 23 is a front, bottom, right side perspective view of the wire retention member of FIG. 15 in an open state;

FIG. 23 is a front, bottom, right side perspective view of the wire retention member of FIG. 15 in an open state;

FIG. 24 is a front, bottom, right side perspective view of the wire retention member of FIG. 15 in an closed state;

FIG. 25 is a front elevational view of the wire retention member of FIG. 15 in an closed state;

Figure 1:
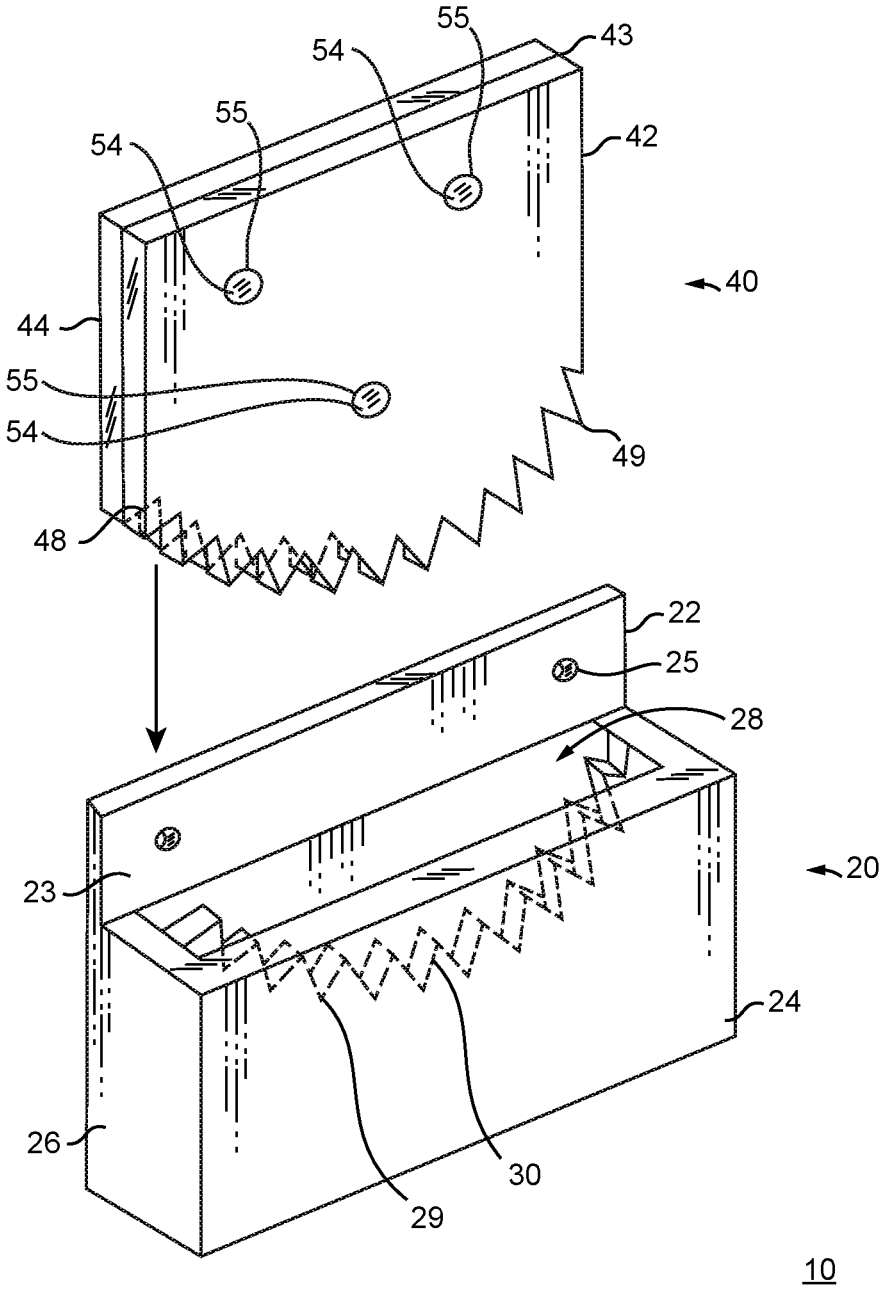
FIG. 1 is a top, left side perspective view of a two-piece wall hanger having a wall mounting receptacle that receives and engages with a wire retention member, which in turn interfaces with a wire strung across a picture frame in accordance with the present invention.
Figure 2:
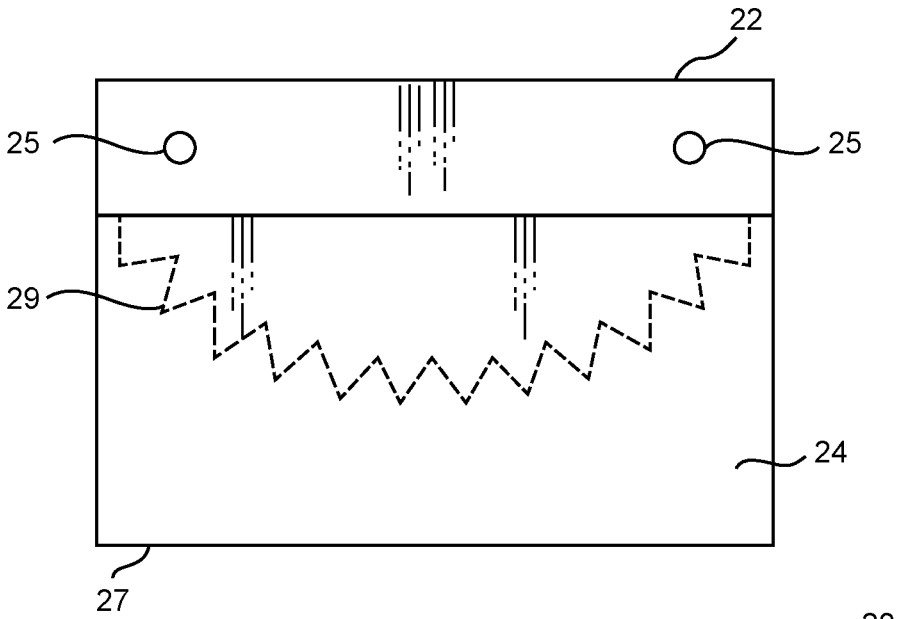
FIG. 2 is a front elevational view of the wall mounting receptacle of the wall hanger thereof.
Figure 3:
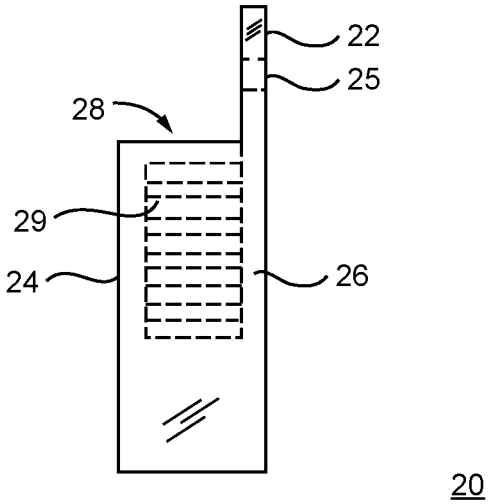
FIG. 3 is a side elevational view of the wall mounting receptacle of the wall hanger thereof.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE EMBODIMENTS

Referring to FIGS. 1-33 of the drawings, various embodiments of a picture wall hanging device is illustratively shown. Referring now to FIGS. 1-14, the picture wall hanger 10 is formed by two retention members, i.e., a wall mounting receptacle 20 and a wire retention member 40, the latter of which is configured to interface with a picture wire 35 mounted on the rear of a picture frame (not shown), as well as interface with the wall mounting receptacle 20.

In particular, the wall mounting receptacle 20 is mounted or otherwise secured to a vertical wall using one or more fasteners (e.g., nail, hook and the like) at a predetermined height such that a plurality of teeth 30 (shown in phantom in FIGS. 1-3) formed within the wall mounting receptacle 20 are orientated to project upwardly. The wire retention member 40 is centered between opposing lateral edges of the picture frame and is configured to interface with the horizontally mounted picture wire so as to retain the wire at the predetermined (central) location and prevent the wire from lateral and vertical slippage. The wire retention member 40 also includes a plurality of teeth which interface with the teeth 30 of the wall mounting receptacle 20. Once the wire retention member 40 secures the wire 35, the wire retention member 40 is inserted into or otherwise engages with the wall mounting receptacle 20 to thereby maintain the picture in a straight, non-tilted orientation on the wall at the predetermined height. Although the illustrative embodiments herein are discussed with having rows of teeth provided in a channel of the wall mounting receptacle 20 and along a bottom portion of the wire retention member 40, such configuration is not considered limiting, as other male/female keying arrangements can be provided to help prevent a frame from inadvertently tilting with respect to the wall upon which the frame is mounted.

Referring now to FIGS. 1-6, the wall mounting receptacle 20 and a first embodiment of the wire retention member 40 are illustratively shown. The wall mounting receptacle 20 is generally rectangular in shape having a planar rear surface 22, an opposing front portion 24, lateral sides 26 and a bottom portion 27 which collectively form a channel or interior chamber 28. The channel 28 has a width and length configured and dimensioned to receive a bottom portion of the wire retention member 40. In one embodiment, a bottom surface 29 of the channel 28 includes a plurality of teeth 30, such as serrated or saw-like teeth as illustratively shown in phantom in FIGS. 1-3. The bottom surface 29 is preferably arcuate in shape, although the shape of the bottom surface 29 and plurality of teeth 30 are not considered limiting. For example, the bottom surface 29 can be linear or curvilinear in shape, and the teeth 30 can be replaced by other male and/or female keying arrangements for interfacing and engaging with a correspondingly keyed bottom of the wire retention member 40.

The picture wall hanger 10 is preferably fabricated from a rigid or semi-rigid material such as polypropylene, polyvinyl chloride (PVC), polyethylene, among other plastic/polymeric materials, or other well-known materials such as ceramics, metal/metal alloys (e.g., aluminum, zinc, brass, stainless steel) and the like, or a combination of various materials thereof. One or more orifices 25 are formed through the wall mounting receptacle 20 in an area away from the channel 28 and are dimensioned to receive a fastener (e.g., a nail, tack, screw, and the like) to hang and secure the wall mounting receptacle 20 to a vertical wall at a predetermined height above the floor or ground thereunder. In one embodiment, a pair of orifices 25 is formed through a flange 23 extending upwardly along the rear 22 of the wall mounting receptacle 20, as illustratively shown in FIG. 1. Alternatively, the orifices 25 can be formed through the front and rear of the receptacle 20 laterally or below the channel 28. A person of ordinary skill in the art will appreciate that the number of orifices 25 is not considered limiting.

Figure 4:
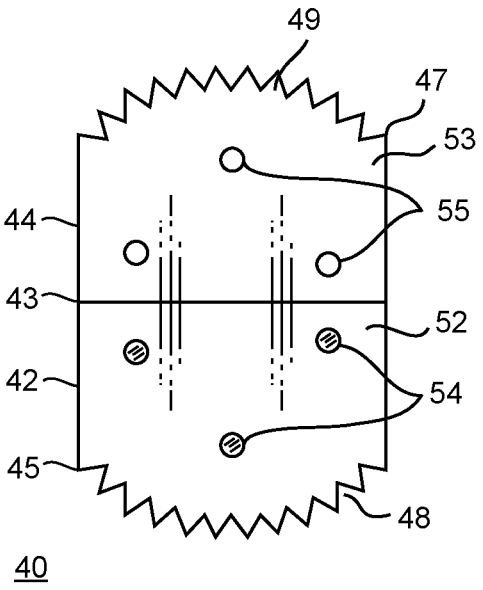
FIG. 4 is a front elevational view of a first embodiment of the wire retention member of FIG. 1 in an open state.
Figure 5:
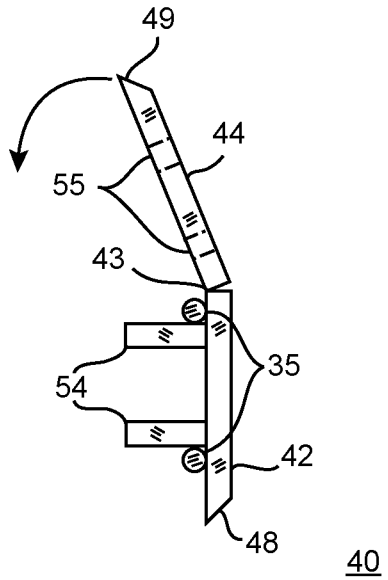
FIG. 5 a side elevational view of the first embodiment of the wire retention member of FIG. 1 illustrating a closing thereof.
Figure 6:
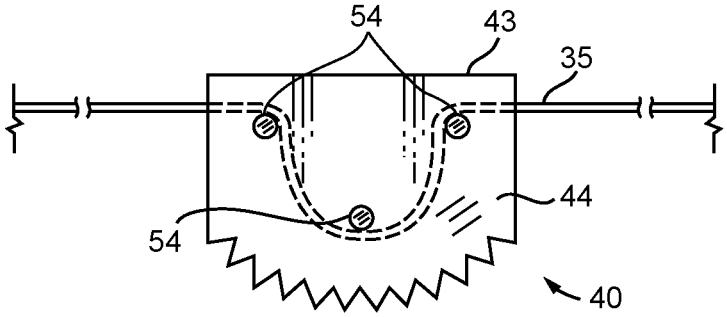
FIG. 6 is a front elevational view of the first embodiment of the wire retention member of FIG. 1 in a closed state and interfacing with a picture hanging wire.

Referring now to FIGS. 1 and 4-7, a first embodiment of the wire retention member 40 is illustratively shown. The wire retention member 40 includes a planar lower shell 42, a planar upper shell 44 and a hinge (e.g., living hinge 43) therebetween. The peripheries of the lower and upper shells 42 and 44 are preferably configured symmetrically and joined at the hinge 43. In FIG. 4, the wire retention member 40 is shown in an open position so that it can receive a picture wire 35, and thereafter retain the picture wire 35 in its closed position, as illustratively shown in FIGS. 6 and 7. The hinge 43 enables a user to manually rotate or fold the upper shell 44 over the lower shell 42 (see, e.g., FIG. 5) such that the inner surface 52 of the lower shell 42 and inner surface 53 of the upper shell 44 are adjacently aligned and the bottom edges 45, 47 of the wire retention member 40 are also aligned to conform to the shape of the bottom surface 29 of the channel 28 of the wall mounting receptacle 20. In the illustrative embodiment shown, the lower and upper edges 45, 47 respectively include a plurality of teeth 48 and 49 which are aligned adjacently with each other in the closed position, and together, conform to and will interface with the plurality of teeth 30 when inserted in the channel 28 of the wall mounting receptacle 20.

The lower shell 42 illustratively includes a plurality of projections or male connectors 54 that extend normally from the inner surface 52. The upper shell 44 similarly includes a plurality of corresponding female connectors (e.g., apertures) 55 aligned with the male connectors 54 and configured to receive the male connectors 54 in the closed position. Preferably, three male projections 54 extend from the inner surface 52 in a triangular configuration with two projections extending distally apart proximate the hinge 43 to form the triangle base and a single projection extending as the apex of the triangular configuration proximate the bottom edge 45 of the lower shell 42. The female connectors 55 are arranged in the same triangular configuration on the upper shell 44 such that when the wire retention member 40 is closed, the male connectors 54 are received and retained (e.g., snap-fit) by the female connectors 55. The triangular configuration of the connectors 54, 55 is preferably a right-triangle, e.g., an Isosceles triangle, although such configuration is not considered limiting. The ends of each male projection 54 can terminate with a bulbous or mushroom shaped portion 56 to better enhance a snap-fit interface and locking mechanism between the male and female connectors 54, 55. Although three male and female connectors 54, 55 are illustratively shown, the quantity thereof is not considered limiting. For example, five male/female connectors 54, 55 can be provide where additional tension on the wire 35 is desired.

Figure 7:
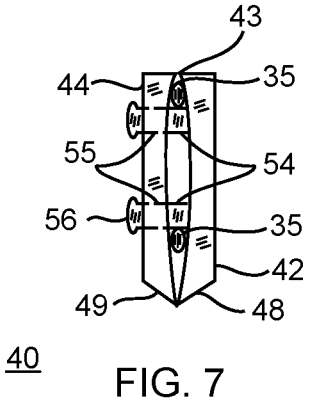
FIG. 7 is a side elevational view of the first embodiment of the wire retention member of FIG. 1 in its closed state and interfacing with the picture hanging wire.

The wire retention member 40 is secured at a central position along a picture wire 35 which is strung horizontally between opposing lateral sides of a picture frame. The wire 35 is secured between the lower and upper shells 42, 44 of the wire retention member 40 by wrapping the wire 35 around the triangularly configured male connectors 54 as illustratively shown in FIG. 6. In particular, the center of the strung wire 35 is tautly wrapped under a lower surface of the single (apex) projection 54 proximate the bottom edge 45 of the lower shell 42 and over an upper surface of the two lateral projections 54 proximate the hinge 43 and forming the base of the triangular configuration. While the wire 35 positioned under and over the male projections 54, the upper shell 54 is manually rotated downwards as shown by the arrow in FIG. 5 so that the female connectors (e.g., apertures or bores) 55 align over and engage (e.g., snap-fit) with the male connectors 54, as shown in FIG. 7. In its closed position, slippage of the wire retention member 40 along the length of the picture wire 35 is prevented by the opposing lateral frictional forces from the inner surfaces 52 and 53 of the lower and upper shells 42, 44 against the entire portion of the wire between the lower and upper shells 42, 44. The lateral forces are constant and maintained by the male/female connector locking mechanism. In addition, the taught routing of the wire 35 under and over the three male projections also provides additional frictional forces on the wire which are orthogonal to the lateral frictional forces created by the locked lower and upper shells 42 and 44.

Once the wire retention member 40 is locked about the central portion of the picture wire 35, the picture frame is ready for hanging on the wall surface. In particular, the aligned bottom edges 45, 47 of the closed and locked wire retention member 40 is inserted into the channel 28 of the wall mounting receptacle 20 such that the teeth 30 at the bottom 29 of the channel 28 interface and engage with the teeth 48/49 of the wire retention member 40. The arcuate shape of the row of teeth 30, 48/49 is preferably provided to enable a user to rotationally adjust the wire retention member 40 relative to the wall mounting receptacle 20 to achieve a level picture frame relative to the wall from which it is being hung. The ability to rotate the wire retention member 40 relative to the wall mounting receptacle 20 is helpful in situations where the user estimates the center of the wire 35 across the picture frame and/or where the picture frame is not centrally balanced, i.e., where one side of the frame is heavier than the other side so that the center of gravity of the picture frame is skewed laterally. Accordingly, the user can adjust the seating of the wire retention member 40 relative in the channel 28 of the wall mounting receptacle 20 to compensate for such illustrative discrepancies.

Figure 8:
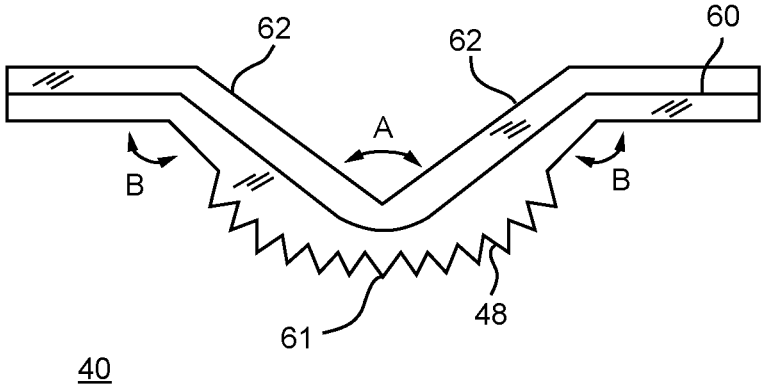
FIG. 8 is a front elevational view of another embodiment of the wire retention member suitable for use with the wall mounting receptacle of FIG. 1.
Figure 9:
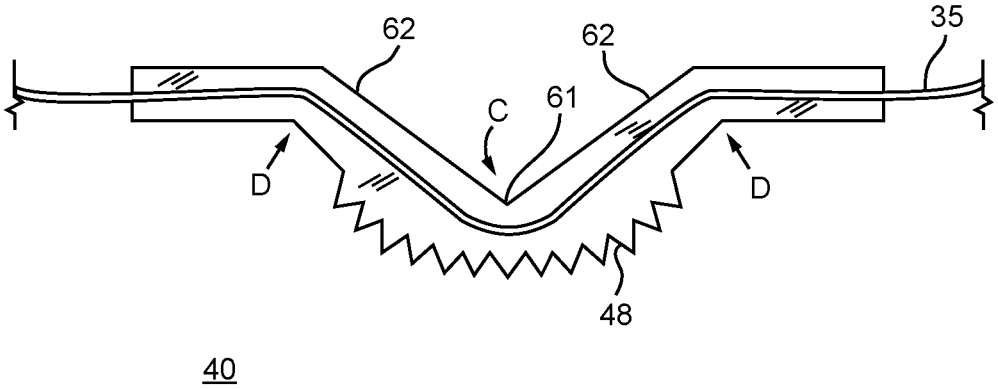
FIG. 9 is a front elevational view of the wire retention member of FIG. 8 interfacing with a picture hanging wire.

Referring to FIGS. 8 and 9, a second embodiment of the wire retention member 40 is illustratively shown. In FIG. 8, the wire retention member 40 is configured as a length of tube having a slit 60 extending along the length thereof for receiving the picture wire 35. The tube is fabricated from a semi-rigid material (e.g., a polymer material as described above) with the slit 60 extending along the longitudinal axis and dimensioned to receive the wire 35 with a minimal amount of flexing by the user and in a direction substantially normal to the longitudinal axis of the wire retention member 40. The slit 60 is preferably positioned along the bottom or lower lateral length of the tubular wire retention member 40. The wire retention member 40 is preferably triangular or V-shaped having an apex 61 which is approximately ninety degrees as shown by angle "A" in FIG. 8. The pair of legs 62 defining the apex 61 each has an opposing end that extend outwardly in a lateral direction at an angle, e.g., of approximately one-hundred and thirty-five (135) degrees as shown by the two angles labeled "B" in FIG. 8. The apex 61 and lower portion of the legs 62 include a plurality of teeth 48 which are configured to engage with the teeth 30 in the channel 28 of the wall mounting receptacle 20, as discussed above with respect to the first embodiment of FIGS. 4-7. Accordingly the tubular wire retention member 40 of FIGS. 8 and 9 is illustratively "V" shaped, although such shape is not considered limiting. For example, the tubular wire retention member 40 can be W-shaped, among other shapes, and include a plurality of teeth 30 at the lower most portion(s) to engage the like bottom surface 29 of the channel 28 of the wall mounting receptacle 20. The inner diameter of the tubular wire retention member 40 is slightly greater than the outer diameter of the picture wire 35. Preferably, the inner diameter of the wire retention member is only one or two diameter gauges greater than the outer diameter of the wire 35. For example, if the picture wire has a gauge of 20, the inner diameter of the tubular wire retention member 40 can have a gauge of 18 or 19.

Referring to FIG. 9, the wire 35 is pushed or slid laterally through the slit 60 so that the tubular wire retention member 40 circumscribes a corresponding length of the wire 35 strung across the picture. The wire 35 bends to conform to the V-shape of the wire retention member 40 such that frictional forces will be provided against the wire at the apex 61 (point "C") and the opposing points where the legs 62 extend horizontally outward at the two points "D" in FIG. 9. The frictional forces help prevent the tubular retention member 40 from slipping laterally with respect to the wire 35.

Figure 10:
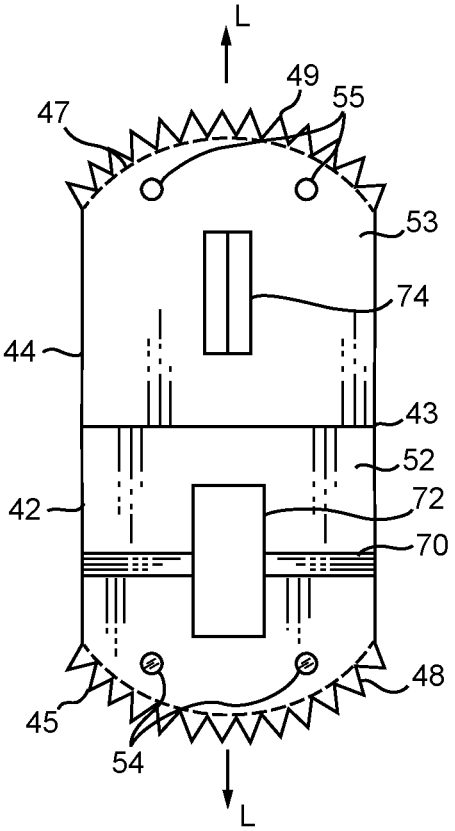
FIG. 10 is a front elevational view of a yet another embodiment of the wire retention member in an open state and suitable for use with the wall mounting receptacle of FIG. 1.
Figure 12:
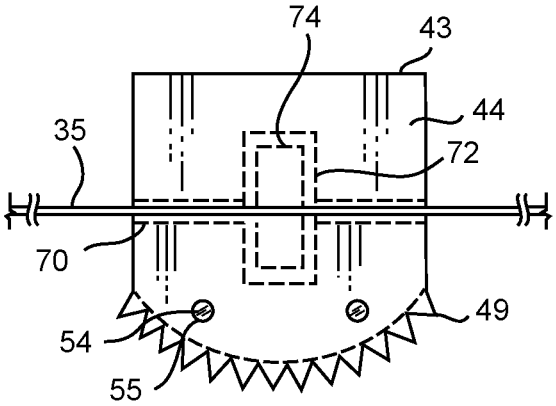
FIG. 12 is a front elevational view of the wire retention member of FIG. 10 in a closed state and interfacing with a picture hanging wire.
Figure 13:
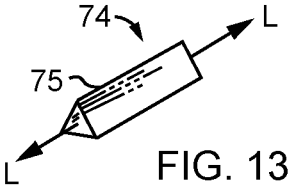
FIG. 13 is perspective view of a wire engagement member of the wire retention member of FIG. 10.

FIGS. 10-14 depict yet another embodiment of a wire retention member 40, which is constructed in a similar manner as the first embodiment shown in FIGS. 4-7. Referring to FIG. 10, the wire retention member 40 includes a planar lower shell 42, a planar upper shell 44 and a hinge (e.g., living hinge 43) therebetween. The peripheries of the lower and upper shells 42 and 44 are preferably configured symmetrically and joined at the hinge 43. In FIG. 10, the wire retention member 40 is shown in an open position so that it can receive a picture wire 35, and thereafter retain the picture wire 35 in its closed position, as illustratively shown in FIG. 12. The hinge 43 enables a user to manually rotate or fold the upper shell 44 over the lower shell 42 (see e.g., FIG. 11) such that the inner surface 52 of the lower shell 42 and inner surface 53 of the upper shell 44 are adjacently aligned and the bottom edges 45, 47 of the wire retention member 40 are also aligned to conform to the shape of the bottom surface 29 of the channel 28 of the wall mounting receptacle 20. In the illustrative embodiment shown, the lower and upper edges 45, 47 respectively include a plurality of teeth 48 and 49 which are aligned adjacently with each other in the closed position, and together, conform to and will interface with the plurality of teeth 30 when inserted in the channel 28 of the wall mounting receptacle 20.

The lower shell 42 illustratively includes a plurality of projections or male connectors 54 that extend normally from the inner surface 52. The upper shell 44 similarly includes a plurality of corresponding female connectors (e.g., apertures) 55 aligned with the male connectors 54 and configured to receive the male connectors 54 in the closed position. Preferably, two male projections 54 extend from the inner surface 52 in a spaced-apart arrangement proximate the lower edge 45 of the lower shell 42. The female connectors 55 are arranged in the same configuration on the upper shell 44 such that when the wire retention member 40 is closed, the male connectors 54 are received and retained (e.g., snap-fit) by the female connectors 55. The ends of each male projection 54 can terminate with a bulbous or mushroom shaped portion 56 to better enhance a snap-fit interface and locking mechanism between the male and female connectors 54, 55. Although two male and female connectors 54, 55 are illustratively shown, the quantity thereof is not considered limiting.

The lower shell 42 includes a central opening 72, which is preferably rectangular in shape having a longitudinal axis "L" (FIG. 10) extending perpendicular to the hinge 43 and row of teeth 48. A channel or groove 70 is formed in the inner surface 52 and extends laterally across and normal to the longitudinal axis of the central opening 72 of the lower shell 42. The channel 70 is configured and dimensioned to receive the picture wire 35 to lessen or eliminate any gap formed between the inner surfaces 52 and 53 when the wire retention member 40 is in its closed and locked state, as well as pervert vertical movement or slippage thereof.

The upper shell 44 further includes a central, elongated wire engagement member 74 which extends outwardly from the upper surface 53 to interface with the picture wire 35 when the wire retention member 40 is closed. The elongated wire engagement member 74 is preferably triangular in shape, as illustratively shown in FIG. 13, and has a longitudinal axis "L" (FIG. 10) that is aligned with the longitudinal axis of the central opening 72, i.e., positioned normal with respect to the hinge 43 and row of teeth 49. The central opening 72 is configured to receive the elongated protrusion 74. In one aspect, the height or length of the central opening 72 as defined along its longitudinal axis is slightly greater than the length of elongated wire engagement member 74 along its corresponding axis. The width of the central opening 72 is dimensioned to receive portions of the wire 35 extending from the channel 70 lateral to the p wire engagement member 74, as illustratively shown in FIGS. 12 and 14. Preferably, the width of the central opening 72 is equal to the width of the wire engagement member 74 plus at a length that is twice the diameter of the picture wire 35. Although a single central opening 72 and corresponding wire engagement member 74 is shown, such quantity and location are not considered limiting. For example, a pair of spaced-apart openings/protrusions can be provided in the wire retention member 40. Further, although the wire engagement member 74 is shown and described as being triangular in shape, such shape is not considered limiting as other shapes (trapezoidal, rectangular, serrated, and the like) are contemplated as well.

Figure 11:
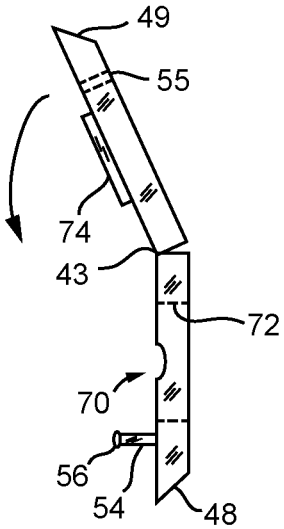
FIG. 11 a side elevational view of the wire retention member of FIG. 10 illustrating a closing thereof.
Figure 14:
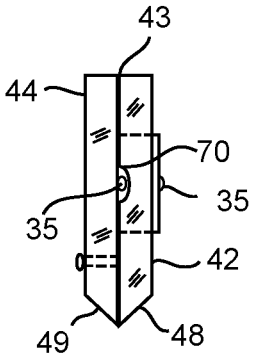
FIG. 14 is a side elevational view of the wire retention member of FIG. 10 in a closed state and interfacing with a picture hanging wire.
Figure 15:
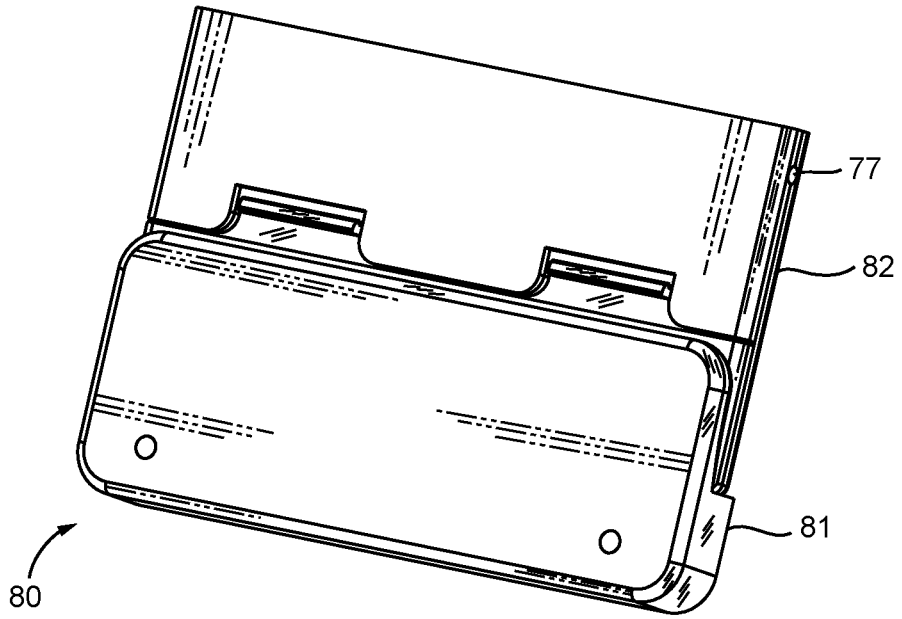
FIG. 15 is a front, top, right side perspective view of still another embodiment of the two-piece wall hanger having a wall mounting member that supports and engages with a wire retention member, which in turn interfaces with a wire strung across a picture frame in accordance with the present invention.
Figure 16:
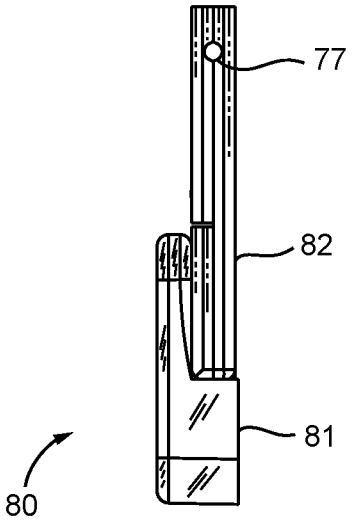
FIG. 16 is a side elevational view of the two-piece wall hanger of FIG. 15.
Figure 17:
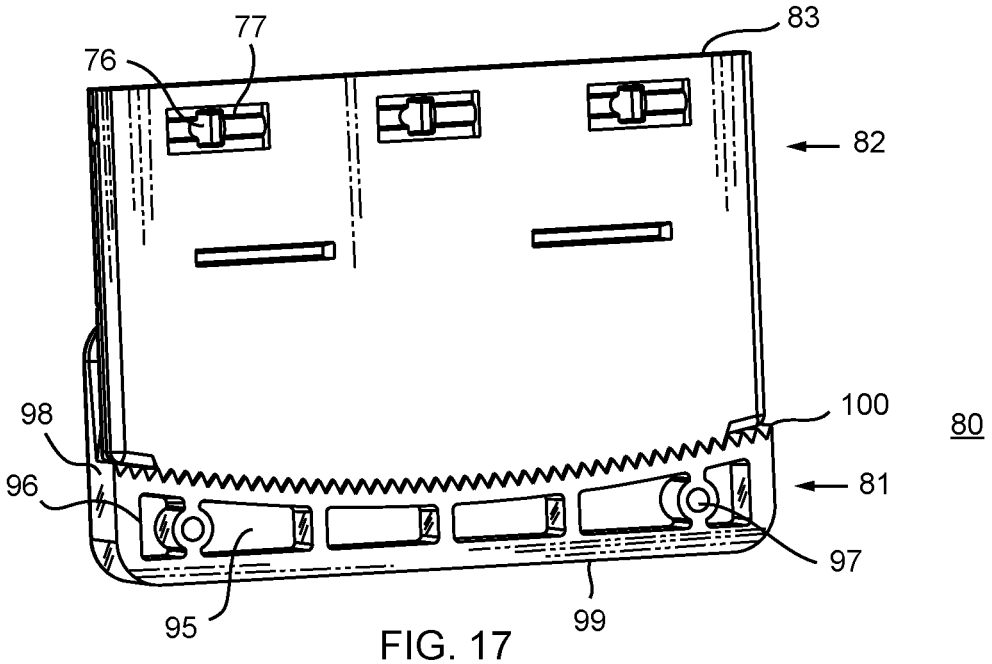
FIG. 17 is a rear, right side perspective view of the two-piece wall hanger illustrating the wall mounting member with a ledge that engages with and supports the wire retention member.

During operation, the central location of the wire 35 that is strung across the picture frame is determined. The channel 70 formed in the lower shell 42 of the wire retention member 40 is positioned about the central location of the wire 35. The upper shell 44 is rotated about the hinge 42 towards the lower shell 42 in the direction of the arrow as shown in FIG. 11 to close the wire retention member 40. Upon closure, the upper surface 75 (FIG. 13) of the wire engagement member 74 interfaces with and applies a force against the wire 35 to bend the wire about the surfaces of the wire engagement member 74. The user then locks the lower and upper shells 42, 44 together by inserting the pair of male connectors 54 through the corresponding female connectors 55. The closed wire retention member 40 pinches and retains the bent picture wire 35 around the wire engagement member 74 and also retains the lengths of the wire lateral to the protrusion in the channel 70 between the inner surfaces 52 and 53 of the lower and upper shells 42, 44. Accordingly, the wire retention member 40 is secured in a fixed position about the central location of the picture wire 35. Slippage of the wire retention member 40 along the wire in any direction is thereby prevented, since the channel 70 prevents movement of the wire 35 in a vertical direction, and the wire engagement member 74 prevents slippage with respect to the wire 35 in a lateral or horizontal direction.

Referring now to FIGS. 15-33 of the drawings, yet another embodiment of the two-piece wall hanger 80 having a wall mounting member 81 and a wire retention member 82 is illustratively shown. The wall mounting member 81 is mounted or otherwise secured to a vertical wall using one or more fasteners (e.g., nail, hook and the like) at a predetermined height such that a plurality of teeth 30 (FIGS. 18-22) formed on a shoulder or ledge 100 of the wall mounting member 81 are orientated to project upwardly. The wire retention member 82 is centered between opposing lateral edges of the picture frame and is configured to interface with the horizontally mounted picture wire so as to retain the wire at the predetermined (central) location and prevent the wire from lateral and vertical slippage. The wire retention member 82 also includes a plurality of teeth 87 (FIGS. 23-28) which interface with the teeth 30 of the wall mounting member 81. Once the wire retention member 82 secures the wire 35, the wire retention member 82 is inserted into or otherwise engages with the wall mounting member 81 to thereby maintain the picture in a straight, non-tilted orientation on the wall at the predetermined height. Although the illustrative embodiments herein are discussed with having rows of teeth provided in a channel of the wall mounting member 81 and along a bottom portion of the wire retention member 82, such configuration is not considered limiting, as other male/female keying arrangements can be provided to help prevent a frame from inadvertently tilting with respect to the wall upon which the frame is mounted.

Figure 18:
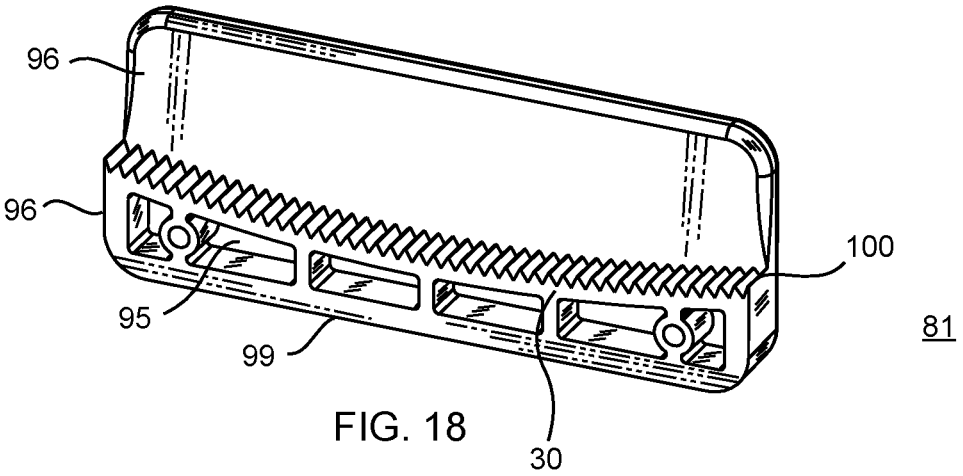
FIG. 18 is a rear, top left side perspective view of the wall mounting member of the wall hanger of FIG. 15 illustrating the ledge with a plurality of teeth.
Figure 19:
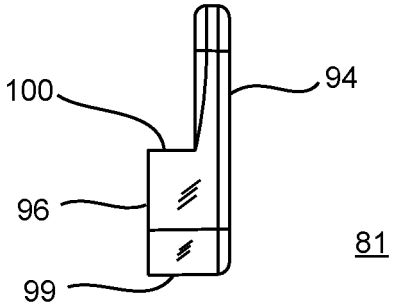
FIG. 19 is a left side elevational view of the wall mounting member of the wall hanger of FIG. 15.
Figure 20:
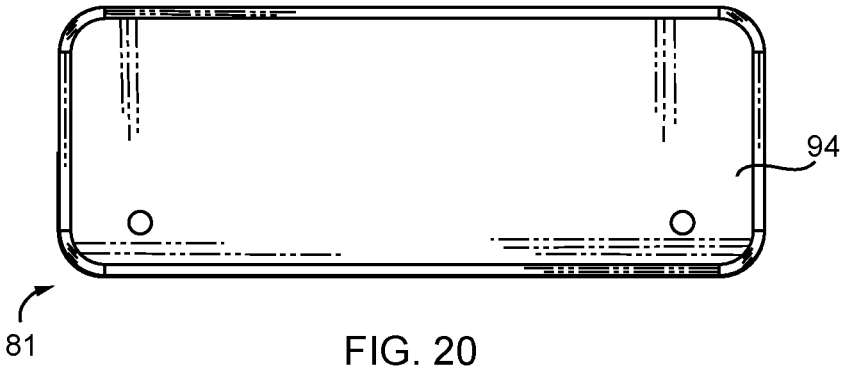
FIG. 20 is a front elevational view of the wall mounting member thereof.
Figure 21:
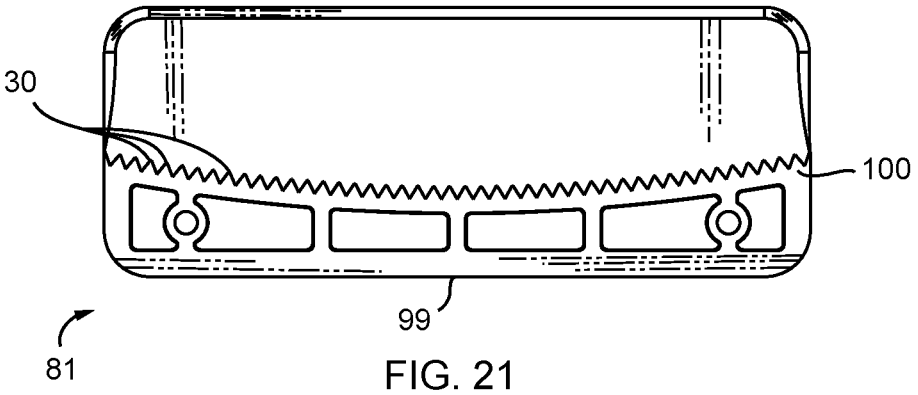
FIG. 21 is a rear elevation view of the wall mounting member thereof.
Figure 22:
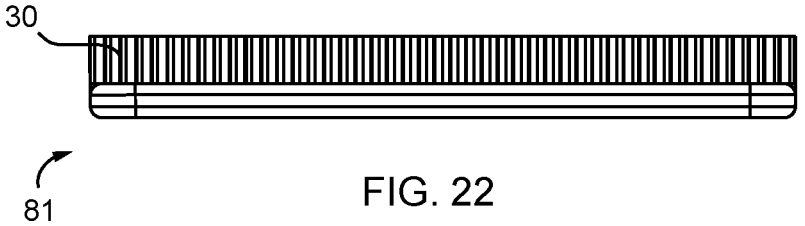
FIG. 22 is a top plan view of the wall mounting member thereof.

Referring now to FIGS. 18-22, the wall mounting member 81 is generally rectangular in shape having a planar front surface 94, an opposing rear portion 96, lateral sides 98 and a bottom portion 99. The profile of the lateral sides 98 of the wall mounting member 81 is generally "L-shaped" having a shoulder or ledge 100 extending rearwardly along the bottom portion 99 as shown in FIGS. 18 and 19. The ledge 100 is sized and dimensioned to support the wire retention member 82 as discussed below in further detail. During operation, the rear portion 96, ledge 100, and the wall or vertical structure from which the wall mounting member 81 is affixed collectively form a channel to receive, adjust and removably retain the wire retention member 82. The ledge 100 has a width and depth configured and dimensioned to receive a bottom portion of the wire retention member 82. A top surface of the ledge 100 includes a plurality of teeth 30, such as serrated or saw-like teeth as illustratively shown in FIGS. 18, 21 and 22. This embodiment of the wall hanging member 80 allows easier and less expensive manufacturing, for example, during plastic molding processes, as compared to other embodiments where the teeth 30 are positioned inside a channel formed in the wall mounting member which would require a more complex mold. Further savings in materials can be obtained by providing cavities 95, for example, in the rear or front surfaces of the wall mounting member 81, while still maintaining structural integrity during the manufacturing process. The teeth 30 extend laterally to the edges of both sides 98 of mounting member 82 to allow the wire retention member 40 a wide rotational range for manual adjustments. The teeth 30 are fashioned in a predetermined size and arc to allow the user to rotate the wire retention member 80 with respect to the wall mounting member 81.

In one embodiment, the wire retention member 80 can be rotated in one-half degree adjustments in and instance where the mounting member 81 and wire retention member 82 were both four (4) inches in width, although such dimensions are not considered limiting. For example, the spacing of the teeth 30, 87 can be made such that the rotational adjustments enable quarter (0.25) degree adjustments for smaller sized frames, as the rotation needs to be adjusted more finely for smaller frames. A person of ordinary skill in the art will appreciate that for larger frames, the rotational adjustments may have to be increased proportionate to better accommodate larger sized frames, as a larger frame will require larger rotational adjustments to properly level it. It has been observed that the 4-inch width design works best for frames with a picture frame wire span (if pulled tight) of 24 inches wide or less. A wider frame would require a wider mounting member 81 and wire retention member 80 so that there is enough tension and less slack in picture frame wire to ensure the frame returns to a level position. The top surface of the ledge 100 is preferably arcuate in shape, although the shape of the top surface 100 and plurality of teeth 30 are not considered limiting. For example, the top surface 100 can be linear or curvilinear in shape, and the teeth 30 can be replaced by other male and/or female keying arrangements for interfacing and engaging with a correspondingly keyed bottom of the wire retention member 82.

The picture wall hanger 80 is preferably fabricated from a rigid or semi-rigid material such as polypropylene, polyvinyl chloride (PVC), polyethylene, among other plastic/polymeric materials, or other well-known materials such as ceramics, metal/metal alloys (e.g., aluminum, zinc, brass, stainless steel) and the like, or a combination of various materials thereof. One or more orifices 97 are formed through the wall mounting member 81 in an area away from the ledge 100 and are dimensioned to receive a fastener (e.g., a nail, tack, screw, and the like) to hang and secure the wall mounting member 81 to a vertical wall at a predetermined height above the floor or ground thereunder. The orifices 97 can be formed through the front and rear of the wall mounting member 81 laterally or below the ledge 100. A person of ordinary skill in the art will appreciate that the number of orifices 97 is not considered limiting.

Figure 26:
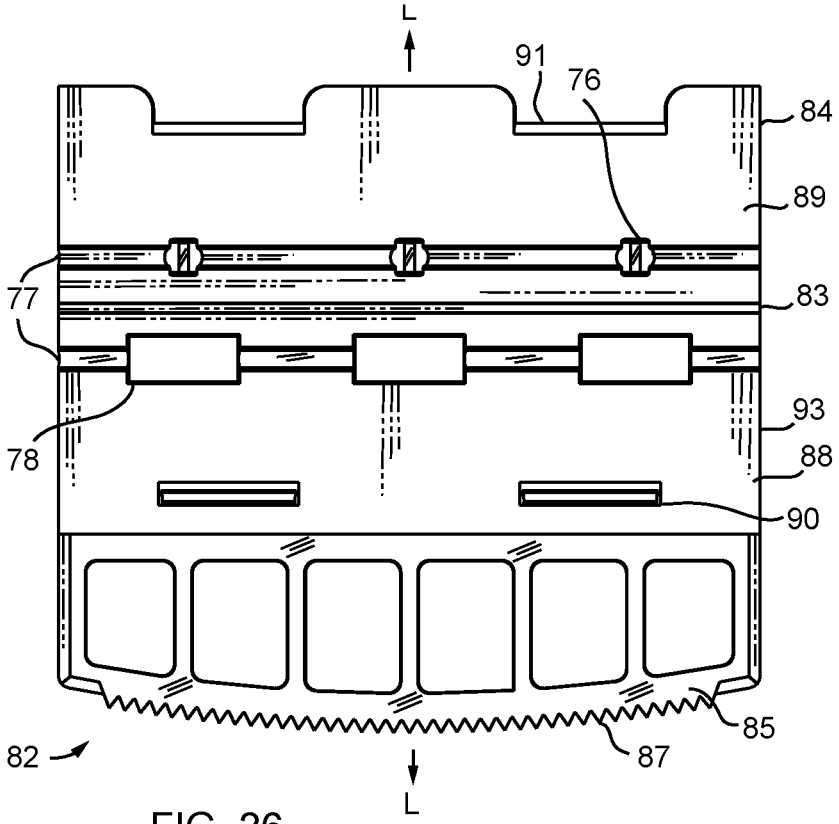
FIG. 26 is a front elevational view of the wire retention member of FIG. 15 in an open state.

Referring now to FIGS. 23-33, the wire retention member 82 includes a planar lower shell 93, a planar upper shell 84 and a hinge (e.g., living hinge 83) therebetween to open and close the wire retention member 82. The peripheries of the lower and upper shells 93 and 84 are preferably configured symmetrically and joined at the hinge 83. Referring to FIG. 26, the wire retention member 82 is shown in an open position so that it can receive a picture wire 35, and thereafter retain the picture wire 35 in its closed position, as illustratively shown in FIGS. 27 and 30. The hinge 83 enables a user to manually rotate or fold the upper shell 84 against the lower shell 93 (see, e.g., see arrow "A" in FIG. 27) such that the inner surface 88 of the lower shell 93 and inner surface 89 of the upper shell 84 are adjacently aligned flush on the wire retention member 82. The ledge 100 extends outwardly from the rear of the wall mounting member 81 a sufficient length to receive and support the bottom portion of the wire retaining member 82 while in its closed state in which the upper portion 84 is folded over and positioned adjacent to the lower portion 93. In the illustrative embodiment shown, the lower edge 85 include a plurality of teeth 87 which conform to and will interface with the plurality of teeth 30 when inserted on the ledge 100 of the wall mounting member 81.

The lower shell 93 illustratively includes a plurality of projections or male connectors 90 that extend normally from the inner surface 88. The upper shell 84 similarly includes a plurality of corresponding female connectors (e.g., ledges) 91 aligned with the male connectors 90 and configured to receive the male connectors 90 in the closed position. Preferably, two male projections 90 extend from the inner surface 88 in a spaced-apart arrangement proximate the hinge 83 to apply ample pressure to the picture frame wire 35 when in the closed position. The female connectors 91 are arranged in the same configuration on the upper shell 84 such that when the wire retention member 82 is closed, the male connectors 90 are received and retained (e.g., snap-fit) by the female connectors 91. The ends of each male projection 90 can terminate with a tooth 92 to better enhance a snap-fit interface and locking mechanism between the male and female connectors 90, 91. Although two male and female connectors 90, 91 are illustratively shown, the quantity thereof is not considered limiting.

The lower shell 93 includes three central openings 78, which is preferably rectangular in shape having a longitudinal axis "L" (FIG. 26) extending perpendicular to the hinge 83 and row of teeth 87. The openings need to be large enough to allow for a gentle flex of the picture frame wire when the wire engagement part 79 clamps onto it. A channel or groove 77 is formed in the inner surface 88 and 89 which extends laterally across and normal to the longitudinal axis of the central opening 78 of the lower shell 93. The channel 77 is configured and dimensioned to receive the picture wire 35 to lessen or eliminate any gap formed between the inner surfaces 88 and 89 when the wire retention member 82 is in its closed and locked state, as well as prevent vertical movement or slippage thereof.

The upper shell 84 further includes a central, elongated wire engagement member 76 which extends outwardly from the upper surface 89 to interface with the picture wire 35 when the wire retention member 82 is closed. The elongated wire engagement member 76 is preferably triangular in shape, as illustratively shown in FIG. 29, and has a longitudinal axis "L" (FIG. 26) that is aligned with the longitudinal axis of the central opening 78, i.e., positioned normal with respect to the hinge 83 and row of teeth 87. The central opening 78 is configured to receive the elongated protrusion 76. In one aspect, the height or length of the central opening 78, as defined along its longitudinal axis, is slightly greater than the length of elongated wire engagement member 76 along its corresponding axis. The width of the central opening 78 is dimensioned to receive portions of the wire 35 extending from the channel 77 lateral to the wire engagement member 76, as illustratively shown in FIGS. 28 and 30. Preferably, the width of the central opening 78 is equal to the width of the wire engagement member 76 plus at a length that is twice the diameter of the picture wire 35. Although a single central opening 78 and corresponding wire engagement member 76 is shown, such quantity and location are not considered limiting. For example, a pair of spaced-apart openings/protrusions can be provided in the wire retention member 82. Further, although the wire engagement member 76 is shown and described as being triangular in shape, such shape is not considered limiting as other shapes (trapezoidal, rectangular, serrated, and the like) are contemplated as well.

Figure 27:
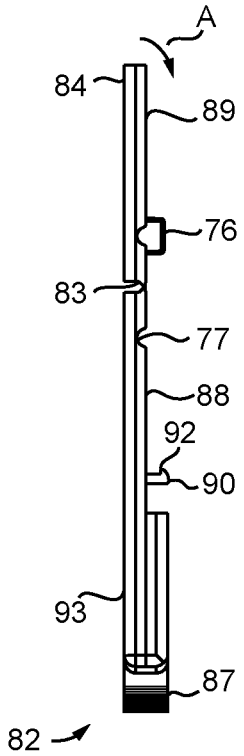
FIG. 27 is a left side elevational view of the wire retention member of FIG. 15 illustrating a closing thereof.
Figure 29:
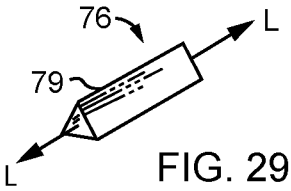
FIG. 29 is perspective view of a wire engagement member of the wire retention member of FIG. 13.
Figure 28:
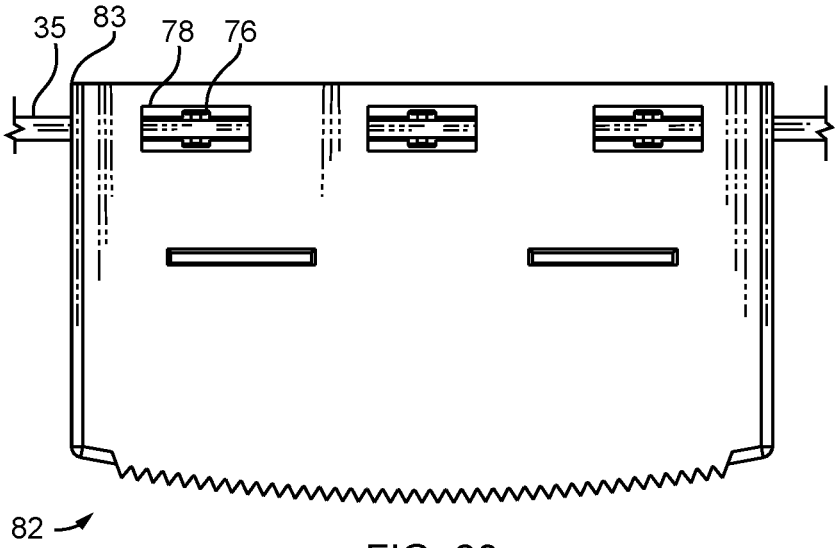
FIG. 28 is a front elevational view of the wire retention member of FIG. 18 in a closed state and interfacing with a picture hanging wire.
Figure 30:
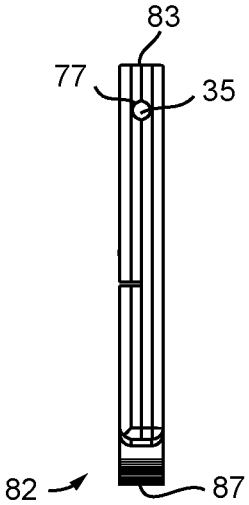
FIG. 30 is a side elevational view of the wire retention member of FIG. 26 in a closed state and interfacing with a picture hanging wire.
Figure 31:
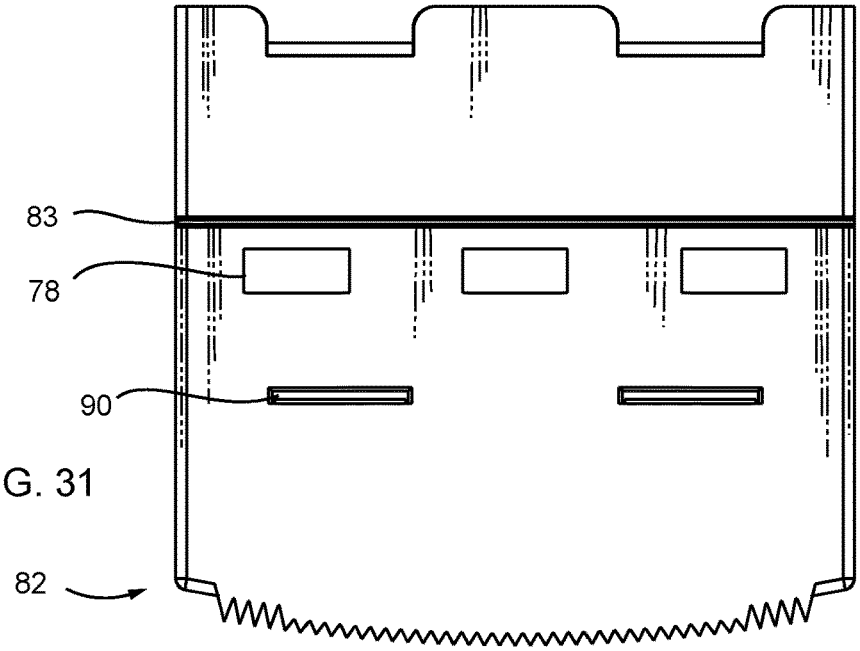
FIG. 31 is a rear elevational view of the wire retention member of FIG. 15 in an open state.
Figure 32:
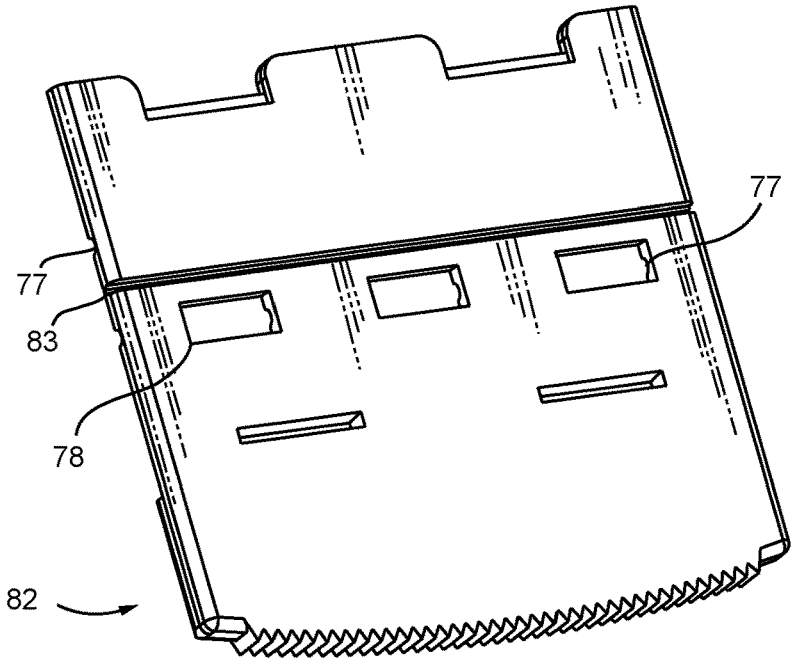
FIG. 32 is a rear, bottom, left side perspective view of the wire retention member of FIG. 15 in an open state.
Figure 33:
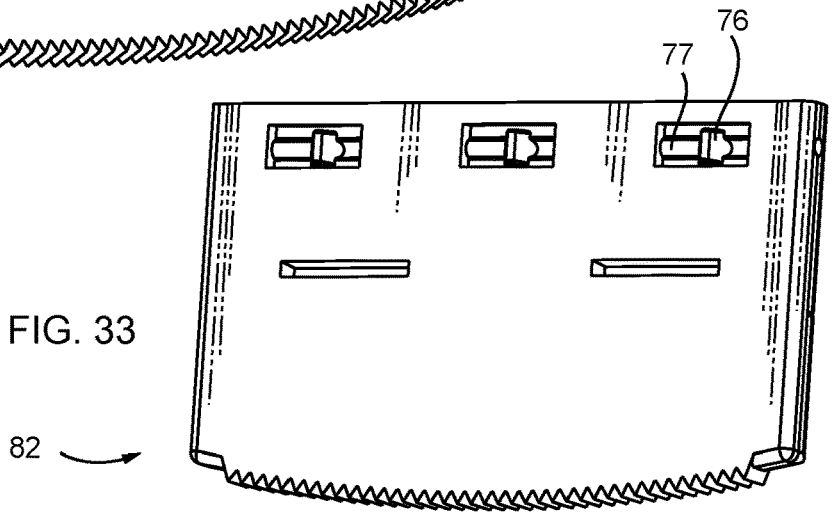
FIG. 33 is a rear, bottom, right side perspective view of the wire retention member of FIG. 15 in a closed state.

During operation, the central location of the wire 35 that is strung across the picture frame is determined. The channel 77 formed in the lower shell 93 of the wire retention member 82 is positioned about the central location of the wire 35. The upper shell 84 is rotated about the hinge 93 towards the lower shell 93 in the direction of the arrow as shown in FIG. 27 to close the wire retention member 82. Upon closure, the upper surface 79 (FIG. 27) of the wire engagement member 76 interfaces with and applies a force against the wire 35 to bend the wire about the surfaces of the wire engagement member 76. The user then locks the lower and upper shells 93, 84 together by inserting the pair of male connectors 90 through the corresponding female connectors 91. The closed wire retention member 82 pinches and retains the bent picture wire 35 around the wire engagement member 76 and also retains the lengths of the wire lateral to the protrusion in the channel 77 between the inner surfaces 88 and 89 of the lower and upper shells 93, 84. Accordingly, the wire retention member 82 is secured in a fixed position about the central location of the picture wire 35. Slippage of the wire retention member 82 along the wire in any direction is thereby prevented, since the channel 77 prevents movement of the wire 35 in a vertical direction, and the wire engagement member 76 prevents slippage with respect to the wire 35 in a lateral or horizontal direction.

While the foregoing is directed to embodiments of the present invention, other and further embodiments and advantages of the invention can be envisioned by those of ordinary skill in the art based on this description without departing from the basic scope of the invention, which is to be determined by the claims that follow.

What is claimed is:

1. A wall hanger for hanging an object on a vertical wall via a wire, comprising:

a wall mounting member having a planar rear portion for mounting to the vertical wall, a front portion spaced apart from the rear portion and a bottom portion, said rear, front and bottom portions defining a ledge accessible from a top portion of the wall mounting member, the ledge having a predetermined width in a horizontal direction and a first keying arrangement;

a wire retention member having a lower shell, an upper shell and a hinge rotatably connecting the lower and upper shells between open and closed positions and configured to receive the wire, the lower and upper shells having peripheral edges with a second keying arrangement corresponding with the first keying arrangement, the first and second keying arrangements configured to engage with each other when the wire retention member is in its closed position; and a plurality of locking members configured to engage and lock the wire retention member in the closed position.

2. The wall hanger of claim 1, wherein the ledge is arcuate in shape.

3. The wall hanger of claim 1, wherein the first and second keying arrangements include a plurality of teeth configured to interface with each other.

4. The wall hanger of claim 1, wherein the ledge extends from the rear portion of the wall mounting member.

5. The wall hanger of claim 1, wherein the first and second keying arrangements are configured to permit rotation of the wire retention member with respect to the wall mounting member.

6. The wall hanger of claim 1, wherein the lower and upper shells include opposing grooves which, when in a closed state, form a channel that extends laterally across the wire retention member and which is dimensioned to receive the wire therein.

7. The wall hanger of claim 6, wherein at least one of the upper and lower shells includes a wire engagement member to prevent slippage of the wire within the channel.

8. The wall hanger of claim 7, wherein one of the opposing grooves comprises a protrusion extending normally therefrom and a correspondingly aligned cutout formed in the opposing groove, the cutout being configured to accommodate the protrusion and a portion of the wire.

9. The wall hanger of claim 7, wherein the protrusion is triangular shaped.

10. The wall hanger of claim 1, wherein the wire retention member includes at least one locking member to retain the lower and upper shells in a closed position.

11. The wall hanger of claim 4, wherein the ledge extends from and between opposing lateral edges of wall hanger.

* * * * *